US006998944B2

(12) United States Patent
Caplan et al.

(10) Patent No.: US 6,998,944 B2
(45) Date of Patent: Feb. 14, 2006

(54) METHOD AND APPARATUS FOR MICROWAVE INTERCONNECTION

(75) Inventors: William L. Caplan, State College, PA (US); Nicholas S. Hodgman, Fort Wayne, IN (US); Thomas B. Chamberlain, Fort Wayne, IN (US); Michael S. Morningstar, Lemont, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 131 days.

(21) Appl. No.: 10/712,394

(22) Filed: Nov. 14, 2003

(65) Prior Publication Data

US 2005/0104682 A1 May 19, 2005

(51) Int. Cl.
*H01P 1/00* (2006.01)

(52) U.S. Cl. ..... 333/260; 333/24 R; 333/247; 333/238

(58) Field of Classification Search ..... 333/260, 333/24 R, 247, 238
See application file for complete search history.

(56) References Cited

U.S. PATENT DOCUMENTS

| | | | | |
|---|---|---|---|---|
| 2,527,146 | A | 10/1950 | Mumford | |
| 2,762,991 | A | 9/1956 | Chlavin | |
| 3,784,726 | A | 1/1974 | Smith et al. | |
| 4,782,313 | A | 11/1988 | Brant, Jr. | |
| 4,837,529 | A | 6/1989 | Gawronski et al. | |
| 4,951,011 | A | 8/1990 | Heckaman et al. | |
| 4,975,065 | A | 12/1990 | Rosenberg et al. | |
| 5,019,829 | A | 5/1991 | Heckman et al. | |
| 5,311,408 | A * | 5/1994 | Ferchau et al. | 361/818 |
| 5,363,075 | A | 11/1994 | Fanucchi | |
| 5,453,750 | A | 9/1995 | Battista et al. | |
| 5,563,562 | A | 10/1996 | Szwec | |
| 5,619,399 | A * | 4/1997 | Mok | 361/707 |
| 5,633,615 | A | 5/1997 | Quan | |
| 5,696,474 | A | 12/1997 | Spivey et al. | |
| 5,797,765 | A | 8/1998 | Barnett et al. | |
| 5,963,111 | A | 10/1999 | Anderson et al. | |
| 5,986,519 | A | 11/1999 | Kellett et al. | |
| 5,994,975 | A | 11/1999 | Allen et al. | |
| 6,028,497 | A * | 2/2000 | Allen et al. | 333/246 |
| 6,076,017 | A | 6/2000 | Taylor et al. | |
| 6,102,709 | A * | 8/2000 | Howard et al. | 439/66 |
| 6,111,474 | A | 8/2000 | Nibe | |
| 6,166,615 | A * | 12/2000 | Winslow et al. | 333/260 |
| 6,417,747 | B1 | 7/2002 | Dearden et al. | |
| 6,878,872 | B1 * | 4/2005 | Lloyd et al. | 174/35 R |

* cited by examiner

*Primary Examiner*—Robert Pascal
*Assistant Examiner*—Kimberly Glenn
(74) *Attorney, Agent, or Firm*—Edell, Shapiro & Finnan

(57) ABSTRACT

Microwave signals are coupled from a microwave module to a microstrip transmission line, each installed on a chassis plate. The microwave signals are fed through the bottom or side of the microwave module using a feedthrough pin mounted in the module. The feedthrough pin extends from the microwave module interior into a channel defined in the chassis plate and to a microstrip line on the opposite side of the plate. An electrically conductive gasket is placed about the feedthrough pin between the microwave module and chassis plate to reduce signal leakage and enhance ground continuity. An insulating sleeve is installed about the feedthrough pin in the chassis plate channel and provides a nominal clearance (e.g., 0.005 inches) within that channel to allow for manufacturing and assembly tolerances and to enable feedthrough impedance to be substantially insensitive to the position of the feedthrough pin and insulating sleeve within the channel.

30 Claims, 6 Drawing Sheets

METHOD AND APPARATUS FOR MICROWAVE INTERCONNECTION

BACKGROUND OF THE INVENTION

1. Technical Field

The present invention pertains to interconnections for microwave signals. In particular, the present invention pertains to coupling microwave signals from a removable microwave module installed on a chassis plate to a microstrip transmission line installed in the chassis plate.

2. Discussion of Related Technology

Microwave signals are typically processed and/or generated in microwave modules and coupled to microstrip transmission lines for signal transference and/or transmission. The microwave modules may be installed on a chassis plate, where the modules and chassis plate each contain a microstrip line. A conventional horizontal feedthrough approach of coupling microwave signals between the microwave module and a microstrip line on a chassis plate is illustrated in FIG. 1. Specifically, a microwave module 12 is installed on a chassis plate 10. The chassis plate includes a microstrip line 16, a microstrip channel 18 and a channel cover 20. Microwave module 12 is installed in a recessed section 22 of the chassis plate, while channel 18 is defined in a chassis plate raised portion adjacent the recessed section and houses microstrip line 16. Channel cover 20 is installed on the upper edges of channel 18 to cover the channel and enclose microstrip line 16 therein. Microstrip line 16 is typically laid into channel 18, where the channel is machined into chassis plate 10 to allow the channel to be covered and thereby electrically isolated from other microstrip transmission lines.

Microwave module 12 processes and/or generates microwave signals, where a feedthrough pin 14 is installed through the side wall of the microwave module adjacent channel 18. Feedthrough pin 14 extends into microstrip channel 18 and is substantially parallel to microstrip line 16. The feedthrough pin is attached, either directly or indirectly, to microstrip transmission line 16 mounted on the chassis plate within channel 18. The feedthrough pin serves to couple microwave signals processed and/or generated by microwave module 12 to microstrip line 16.

The configuration described above has several disadvantages. In particular, the conventional horizontal feedthrough approach described above provides a gap between the microwave module side wall and the covered channel containing the microstrip line. This gap produces signal leakage that can impact isolation of other signals on the chassis plate. Although gaskets may be utilized to impede signal leakage, this is problematic due to the need to establish horizontal pressure on the gasket in a vertical mounting direction and to maintain adequate pressure on the gasket over temperature variations in the presence of possibly differing coefficients of thermal expansion (CTE) (e.g., the fractional increase in length of an object for each degree of increased temperature) between the microwave module and chassis plate. Further, the gasket is required to maintain equal pressure on the vertical faces of both the chassis plate raised portion and the channel cover, thereby requiring the channel cover to be installed with high precision to align exactly with the edge of the chassis plate raised portion. Some mechanical configurations are commonly utilized to rectify this problem; however, these tend to complicate the feedthrough approach.

In addition, the gap creates an inductive ground discontinuity by forcing return currents to flow down the chassis plate raised portion face and up the face of the microwave module wall. The greater the height of the microwave module, the more severe the discontinuity. Although ground ribbons may be installed on either side of the feedthrough pin or conductive material may be placed to fill the gap in order to mitigate the ground discontinuity, these courses of action require complicated assembly and are not electrically ideal.

OBJECTS AND SUMMARY OF THE INVENTION

Accordingly, it is an object of the present invention to feed microwave signals vertically through the bottom of a microwave module to a microstrip line on a chassis plate.

It is another object of the present invention to employ an electrically conductive gasket about a feedthrough pin extending between a microwave module and chassis plate to reduce signal leakage and enhance ground continuity, thereby enhancing feedthrough performance.

Yet another object of the present invention is to employ an insulating sleeve on a feedthrough pin extending between a microwave module and a chassis plate to permit a larger chassis plate feedthrough passage to maintain system impedance (e.g., 50 ohms), to reduce sensitivity to mechanical misalignment and to prevent shorting of the feedthrough pin to the chassis plate due to assembly tolerances.

Still another object of the present invention is to provide a nominal clearance (e.g., 0.005 inches) between an insulating sleeve of a microwave module feedthrough pin and a microstrip channel in a chassis plate to render feedthrough impedance substantially insensitive to the position of the pin and sleeve within the channel and to accommodate manufacturing and assembly tolerances for single or plural pins in the microwave module.

The aforesaid objects may be achieved individually and/or in combination, and it is not intended that the present invention be construed as requiring two or more of the objects to be combined unless expressly required by the claims attached hereto.

According to the present invention, microwave signals are coupled from a removable microwave module disposed or installed on a chassis plate to a microstrip transmission line disposed or installed in the plate. The microwave signals are fed through the bottom or side of the microwave module using a feedthrough pin mounted in the module and hermetically sealed, if necessary. The feedthrough pin extends from the microwave module interior into a channel defined in the chassis plate and to a microstrip line on the opposite side of the plate. An electrically conductive gasket is disposed or installed about the feedthrough pin between the microwave module and chassis plate to reduce signal leakage and enhance ground continuity, thereby enhancing the voltage standing wave ratio (VSWR) performance of the feedthrough. The microwave module is installed in the same direction as the feedthrough pins, thereby allowing the use of fasteners to apply uniform, reliable pressure to the gasket and ensuring prevention of signal leakage. The electrically conductive gasket provides reliable, positive contact all around the feedthrough pin to prevent the ground discontinuity inherent within the conventional horizontal feedthrough approach as described above.

An insulating sleeve is disposed or installed about the feedthrough pin in the chassis plate channel. The sleeve prevents shorting of the pin to the chassis plate resulting from assembly tolerances and allows a larger feedthrough channel in the chassis plate to maintain system impedance (e.g., 50 ohms). The sleeve further reduces sensitivity to mechanical misalignment. The feedthrough pin and sleeve provide a nominal clearance (e.g., 0.005 inches) within the chassis plate channel. This allows for manufacturing and assembly tolerances for single or plural pins in the microwave module and enables feedthrough impedance to be substantially insensitive to the radial position of the feedthrough pin and insulating sleeve within the channel.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
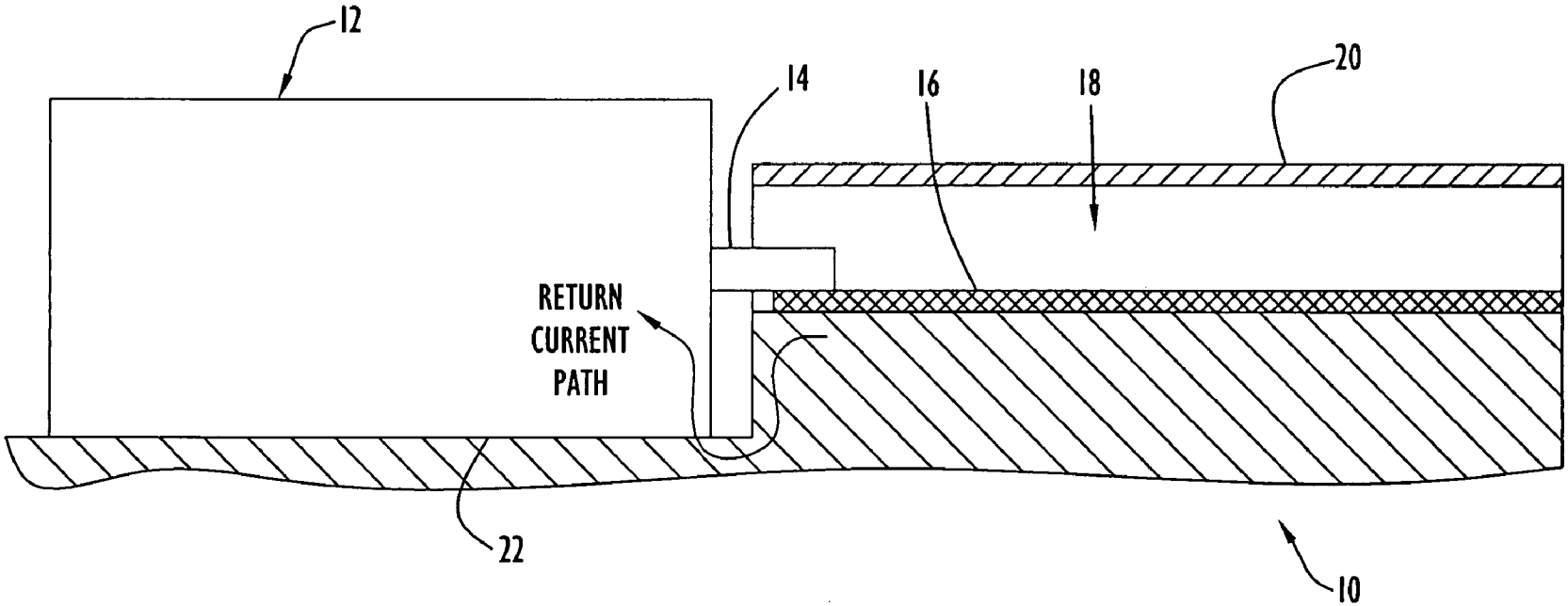
FIG. 1 is a view in elevation and partial section of a conventional horizontal feedthrough configuration for coupling microwave signals between a microwave module and a microstrip line on a chassis plate.
Figure 2:
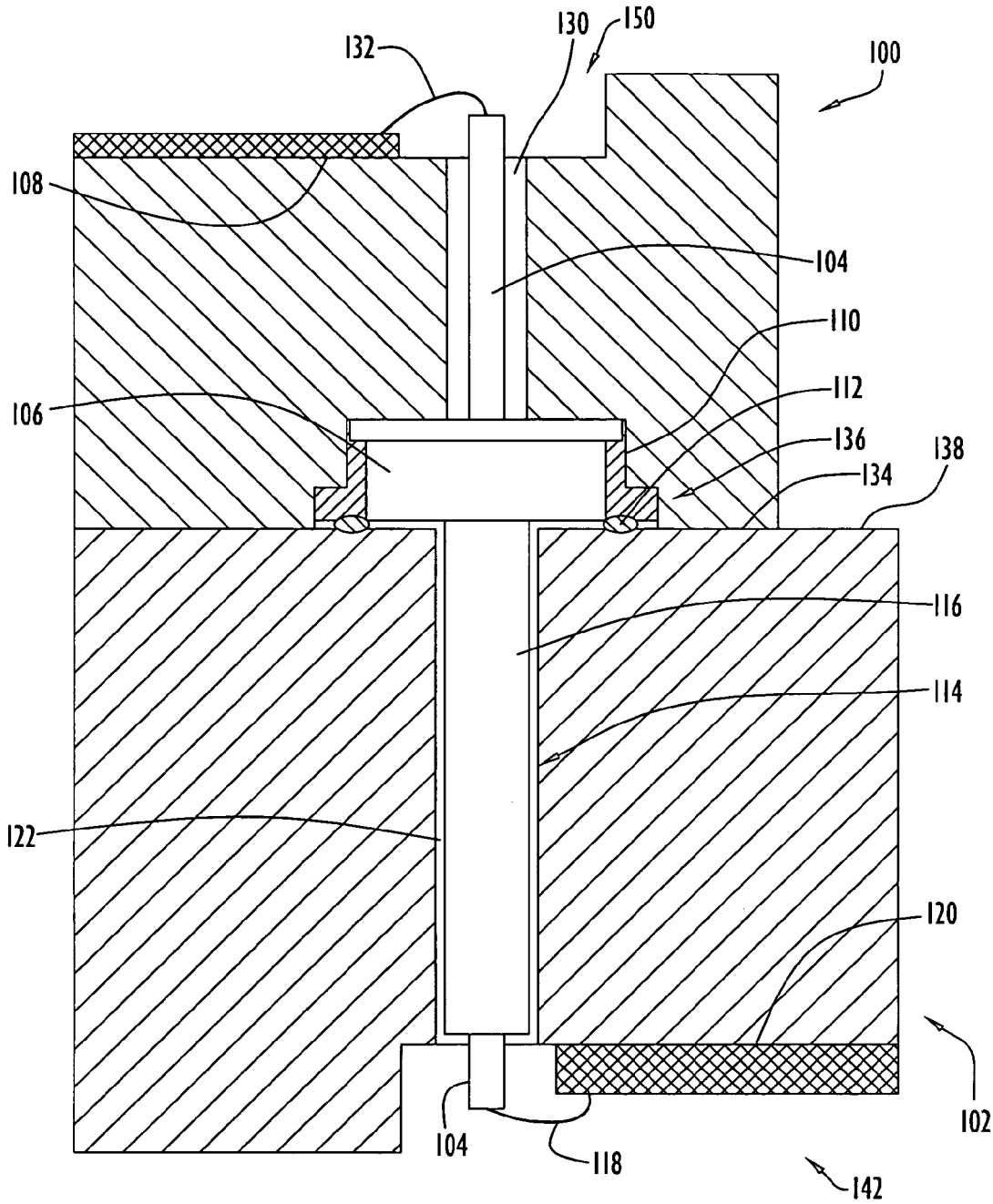
FIG. 2 is a view in elevation and partial section of a feedthrough configuration for coupling microwave signals between a microwave module and a microstrip line on a chassis plate according to the present invention.
Figure 3:
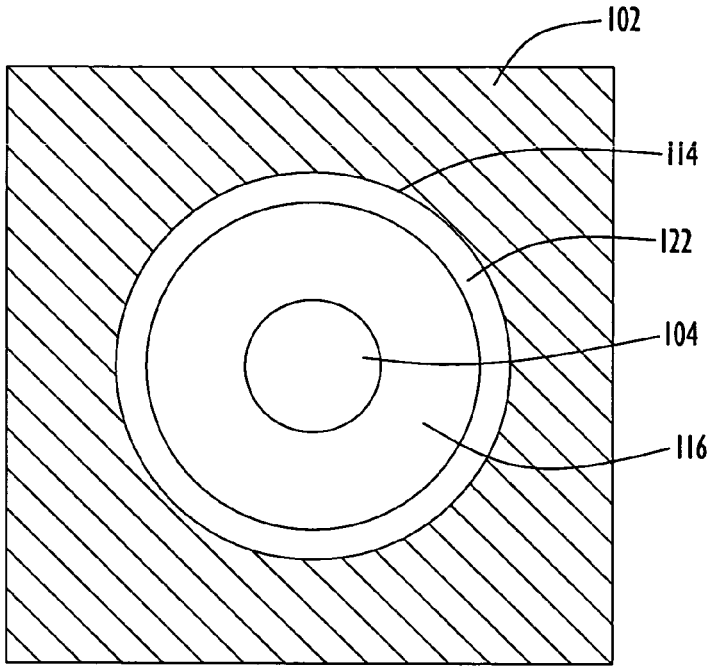
FIG. 3 is a bottom view in partial section of the insulating sleeve and feedthrough pin of FIG. 2 installed in a substantially concentric fashion within the chassis plate channel.
Figure 4:
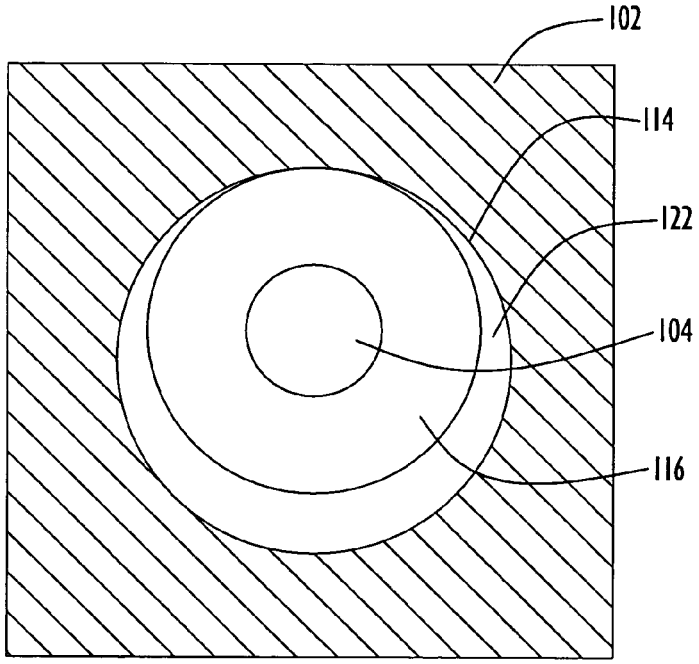
FIG. 4 is a bottom view in partial section of the insulating sleeve and feedthrough pin of FIG. 2 installed within the chassis plate radially offset from a substantially concentric position.

A configuration for coupling microwave signals between a microwave module and a microstrip transmission line disposed or installed on a chassis plate according to the present invention is illustrated in FIGS. 2–4. Specifically, the configuration includes a microwave module 100, a chassis plate 102 and a feedthrough pin 104 coupling microwave signals between the microwave module and chassis plate as described below. Microwave module 100 includes corresponding electronics (not shown) to generate and/or process microwave signals for transference to the chassis plate and may be implemented by any conventional or other devices. The microwave module is disposed or installed adjacent and above chassis plate 102 to provide a vertical arrangement and includes a microstrip transmission line 108 disposed or installed therein that receives microwave signals from the module electronics. Microstrip line 108 may be installed within an enclosed channel 150 defined in the microwave module and is oriented substantially perpendicular to feedthrough pin 104 to provide microwave signals to the feedthrough pin via a wire or ribbon bond 132. By way of example only, the configuration of FIG. 2 illustrates a right-angle launch (e.g., with respect to the positions of the microstrip line and feedthrough pin) inside the microwave module, but the present invention may be applied to other types of launches as described below. It is to be understood that the terms "top", "bottom", "front", "rear", "side", "height", "width", "length", "upper", "lower", "right", "left", "vertical", "horizontal" and the like are used herein merely to describe points of reference and do not limit the present invention to any particular configuration or orientation.

The feedthrough pin is substantially cylindrical and is disposed or installed in a substantially cylindrical passage 130 defined within the microwave module and extending from microstrip line 108 toward a microwave module bottom wall 134. The dimensions of passage 130 are chosen to achieve the desired system impedance (e.g., 50 ohms) when coupled with feedthrough pin 104. Feedthrough pin 104 extends within passage 130 from the microwave module interior and through microwave module bottom wall 134 into chassis plate 102. A seal 106, preferably a conventional hermetic glass-to-metal seal, is disposed or installed about feedthrough pin 104 within the microwave module toward the module bottom wall to maintain hermicity within the microwave module. The microwave module includes a recessed section 136 defined in the module bottom wall and extending to a distal end of passage 130. The recessed section includes dimensions sufficient to accommodate the seal. Seal 106 may be installed within microwave module 100 via any conventional installation materials 110 (e.g., adhesives, solder, etc.) or other techniques. For example, feedthrough pin 104 may be a prefabricated feedthrough pin with a glass-to-metal seal for soldering within the microwave module, or the feedthrough pin and seal may be fired directly into place in the microwave module.

The microwave module bottom wall is fastened to a chassis plate top wall 138, while an electrically conductive gasket 112 is disposed or installed between the underside of seal 106 and the chassis plate top wall. The gasket is substantially annular in the form of a circular ring and includes dimensions slightly greater than those of seal 106. Feedthrough pin 104 is concentrically disposed or installed through the gasket for the purpose of creating a continuous electrical shield around the feedthrough pin when that pin traverses a gap between the microwave module bottom wall and the chassis plate. The gasket reduces signal leakage and enhances ground continuity, thereby enhancing the voltage standing wave ratio (VSWR) performance of the feedthrough. The microwave module is installed in the same direction as the feedthrough pin, thereby allowing the use of fasteners to apply uniform, reliable pressure to the gasket and ensuring prevention of signal leakage. This enables the gasket to provide reliable, positive contact all around the feedthrough pin to prevent ground discontinuity. The gasket is preferably constructed of a deformable metal (e.g., gold, copper, tin, lead, indium, any alloys thereof, or other suitable materials) and includes a diameter selected to minimize the discontinuity between the seal and the chassis plate.

A substantially cylindrical channel 114 is defined in the chassis plate generally coincident with passage 130 of the microwave module. Plate channel 114 receives the portion of feedthrough pin 104 extending external of the microwave module, and extends from the chassis plate top wall to a microstrip transmission line 120 disposed or installed within the chassis plate. An insulating sleeve 116 is disposed or installed about feedthrough pin 104 within plate channel 114 to form a controlled-impedance coaxial signal path vertically through the chassis plate. The insulating sleeve is designed to have an interference fit to the feedthrough pin, thereby eliminating the need for mechanical capture to secure the sleeve to the pin. The insulating sleeve is preferably fabricated from a relatively pliable material, such as PTFE, to allow the sleeve to be easily pressed on the feedthrough pin. Feedthrough pin 104 extends beyond the distal ends of the sleeve and plate channel and is coupled to plate microstrip line 120 via a wire or ribbon bond 118. The plate microstrip line is placed perpendicular to the portion of feedthrough pin 104 extending beyond the plate channel and receives microwave signals from the feedthrough pin via wire bond 118. The plate microstrip line may be installed within an enclosed channel 142 defined in the chassis plate and basically provides microwave signals for various applications.

The respective dimensions of the feedthrough pin, insulating sleeve and plate channel are designed to achieve a coaxial transmission medium impedance matched to the required system impedance, typically 50 ohms. Plate channel 114 includes dimensions sufficient to form a clearance gap 122, preferably on the order of 0.005 inches on the radius, between insulating sleeve 116 and the plate channel wall to allow for fabrication and assembly tolerances for single or plural pins in the microwave module. The position of the feedthrough pin and insulating sleeve within plate channel 114 may deviate from a concentric or coaxial location (FIG. 3). The maximum distance this position may deviate is limited by the clearance gap (FIG. 4). The insulating sleeve serves to reduce impedance variations caused by deviation of the feedthrough pin from the coaxial position within the plate channel. The insulating sleeve further serves to prevent shorting of the pin to the plate channel wall resulting from assembly tolerances and allows a larger diameter channel in the chassis plate to maintain system impedance (e.g., 50 ohms).

Figure 5:
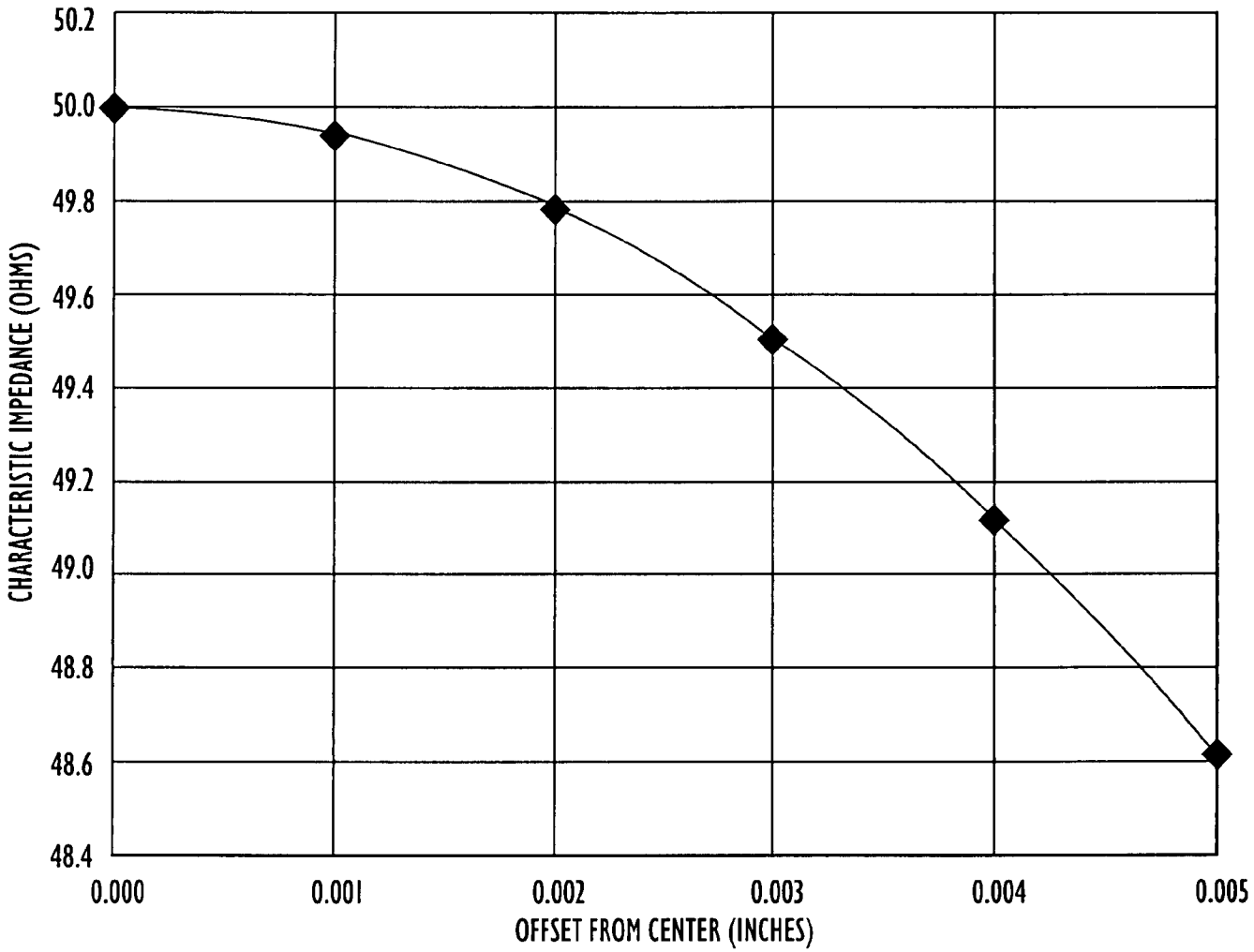
FIG. 5 is a plot graphically illustrating the relationship between impedance and the insulating sleeve and feedthrough pin radial position within the chassis plate channel.

By way of example only, the feedthrough pin may include a diameter of approximately 0.020 inches, the insulating sleeve may include an outer diameter of approximately 0.051 inches, and the plate channel may include an inner diameter approximately 0.061 inches, while the insulating sleeve may be constructed of PTFE. With these dimensions and materials, the characteristic impedance of the coaxial transmission configuration varies only 2.8%, from 50.0 ohms to 48.6 ohms (a VSWR of 1.03:1), as the position of the feedthrough pin varies from the coaxial position to a maximum deviated position offset from the coaxial position by the clearance gap (e.g., 0.005 inches). A graphical illustration of this relationship, by way of example only, is illustrated in FIG. 5. Without the insulation sleeve, a comparable 50 ohm configuration with a feedthrough pin diameter of 0.020 inches requires a channel inner diameter of 0.046 inches. In this case, a feedthrough pin position offset of 0.005 inches causes an impedance variation of 7.4%.

Figure 6:
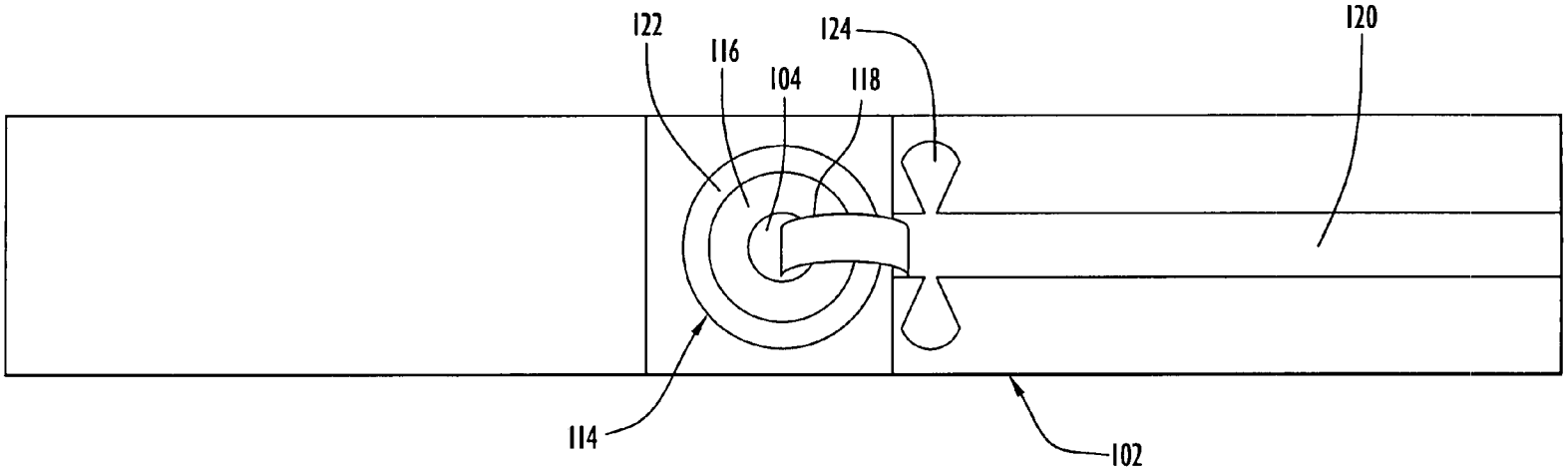
FIG. 6 is a bottom view in plan of the chassis plate, insulating sleeve and feedthrough pin of FIG. 2 including the microstrip line with capacitive stubs to compensate for inductance of the wire interconnect between the microstrip line and feedthrough pin according to the present invention.

Referring to FIG. 6, printed capacitive stubs 124, preferably two, are connected to microstrip line 120 proximate wire or ribbon interconnect 118 installed between the microstrip line and the feedthrough pin within the chassis plate. The stubs are preferably in the form of butterfly stubs, with each stub extending transversely from an opposing microstrip line longitudinal side. The stubs are employed to compensate for the inductance of the wire or ribbon interconnect and to reduce the electrical reflection at high frequencies. The stubs may alternatively be implemented by any suitable devices or techniques to obtain a shunt capacitance in close proximity to the interconnect wire or ribbon. In addition, the capacitive stubs may be employed for the interconnection between microstrip line 108 (FIG. 2) of the microwave module and the feedthrough pin in substantially the same manner described above.

Figure 7:
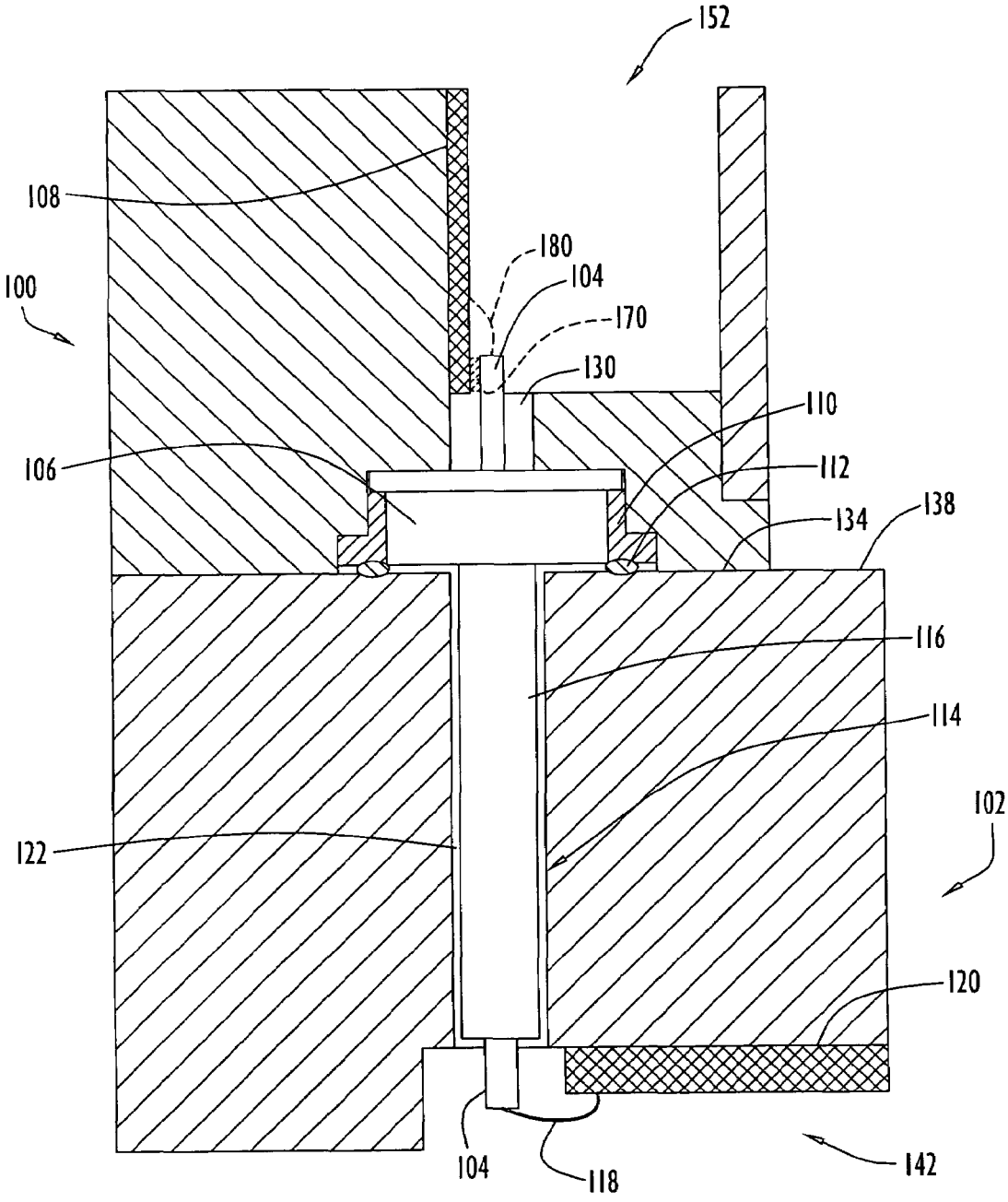
FIG. 7 is a view in elevation and partial section of an alternative feedthrough configuration for coupling microwave signals between a microwave module and a microstrip line on a chassis plate according to the present invention.

The present invention may alternatively be employed with various types of launches. By way of example only, a horizontal launch (e.g., with respect to the positions of the microwave module microstrip line and feedthrough pin) is illustrated in FIG. 7. Initially, this configuration is substantially similar to the configuration described above for FIG. 2, except that microstrip line 108 is placed within the microwave module substantially parallel to feedthrough pin 104. Specifically, the configuration includes microwave module 100, chassis plate 102 and feedthrough pin 104 with seal 106 and sleeve 116, each substantially similar to the corresponding components described above. The feedthrough pin couples microwave signals between the microwave module and chassis plate as described above. The microwave module is installed adjacent and above chassis plate 102 to provide a vertical arrangement and includes microstrip transmission line 108 placed therein that receives microwave signals from microwave module electronics as described above. The microstrip line may be installed within an enclosed channel 152 defined in the microwave module, and is positioned slightly offset from and substantially parallel to feedthrough pin 104 for connection to that pin via direct solder 170 or a ribbon 180 to provide microwave signals to the feedthrough pin.

The feedthrough pin is placed in passage 130 defined within the microwave module and extending from microstrip line 108 toward microwave module bottom wall 134 as described above. The lengths of passage 130 and the feedthrough pin portion placed within the microwave module are less than the lengths of the corresponding components described above for FIG. 2 due to the vertical orientation of the module microstrip line. Feedthrough pin 104 extends within passage 130 from the microwave module interior and through microwave module bottom wall 134 into chassis plate 102. Seal 106 is installed about feedthrough pin 104 within the microwave module toward the module bottom wall as described above.

The microwave module bottom wall is fastened to a chassis plate top wall 138, while gasket 112 is installed about the feedthrough pin between the underside of seal 106 and the chassis plate top wall as described above. Channel 114 is defined in the chassis plate generally coincident passage 130 of the microwave module and receives the portion of feedthrough pin 104 extending external of the microwave module as described above. Insulating sleeve 116 is placed about feedthrough pin 104 within plate channel 114, where the feedthrough pin extends beyond the distal ends of the sleeve and plate channel and is coupled to plate microstrip line 120 via wire or ribbon bond 118 as described above. The respective dimensions of the feedthrough pin, insulating sleeve and plate channel form clearance gap 122 within the plate channel between the insulating sleeve and plate channel wall as described above. The plate microstrip line is installed substantially perpendicular to the portion of feedthrough pin 104 extending beyond the plate channel and receives microwave signals from the feedthrough pin via wire bond 118. The plate microstrip line may be positioned within an enclosed channel 142 defined in the chassis plate and provides microwave signals for various applications as described above.

The present invention provides interconnection of microwave modules to a chassis plate with significant reduction in signal leakage relative to the conventional horizontal feedthrough, while retaining at least comparable tolerance to assembly and manufacturing variations.

It will be appreciated that the embodiments described above and illustrated in the drawings represent only a few of the many ways of implementing a method and apparatus for microwave interconnection.

The microwave module may be of any quantity, type, shape or size and may be placed at any suitable locations on the chassis plate. The microwave module may include any suitable configuration with any quantity of passages, channels, cavities or chambers of any shape or size placed or defined in the module at any locations in any orientations. The module passages and recessed section may be of any quantity, shape or size and may be disposed or defined in the module at any locations in any orientations. The microwave module may be secured or attached to the chassis plate via any conventional or other techniques (e.g., removably attached, fastened, secured, etc.). The microwave module may include or be coupled to any conventional or other circuitry, electronics or devices to generate and/or process signals at any desired frequency (e.g., microwave, etc.). These components may be installed at any locations and may be coupled or provide the resulting signals to the module or microstrip line in any fashion (e.g., directly connected, a conductor, etc.). The present invention may be utilized with launches in any desired orientations.

The chassis plate may be of any quantity, shape or size and may be constructed of any suitable materials. The chassis plate may include any suitable configuration with any quantity of channels, cavities or chambers of any shape or size installed or defined in the plate at any locations in any orientations. The plate channels may be of any quantity, shape or size and may be positioned or defined in the chassis plate at any locations in any orientations. The present invention may be employed to transfer signals between any quantity of microwave modules and any quantity of any type of mounting structure (e.g., chassis or other plate, platform, brackets, etc.) for any applications.

The feedthrough pin may be of any quantity, shape or size, may be installed at any locations in any orientations and may be constructed of any materials suitable for conducting signals. The feedthrough pin may be implemented by any type of conventional or other conductors. The feedthrough pin may be installed or attached to the microwave module and chassis plate via any conventional or other fastening techniques. The feedthrough pin and corresponding components (e.g., sleeve, seal, etc.) may be separate components or be attached or formed integral with each other in any desired combinations. The pin may be solid or include any degree of hollowness sufficient to transfer signals. The feedthrough pin may be installed in or through any walls of the microwave module and chassis plate (e.g., top, bottom, side, etc.).

The seal may be of any quantity, shape or size, may be installed at any locations in any orientations and may be implemented by any conventional (e.g., glass-to-metal hermetic seal, etc.) or other seals. The seal is preferably a hermetic seal, but may be utilized without being hermetically sealed. The seal may be installed or attached to the microwave module via any conventional or other fastening techniques and/or materials (e.g., adhesives, solder, etc.).

The gasket may be of any quantity, shape or size, may be installed at any locations in any orientations and may be constructed of any suitable materials (e.g., gold, copper, tin, lead, indium, any alloys thereof, etc.). The gasket may be installed or attached to the microwave module and chassis plate via any conventional or other fastening techniques or materials (e.g., fasteners, adhesives, grooves, etc.). The gasket may be implemented by any type of conventional or other spacer having suitable conductive properties.

The insulating sleeve may be of any quantity, shape or size, may be installed at any locations in any orientations and may be constructed of any suitable materials (e.g., PTFE, etc.). The insulating sleeve may be attached to the feedthrough pin via any conventional or other fastening techniques and may partially or entirely surround any portions of the feedthrough pin. The clearance formed between the insulating sleeve and channel wall is preferably approximately 0.005 inches, but may be of any suitable dimensions.

The wire or ribbon bonds may be of any quantity, shape or size, may be positioned at any suitable locations and may be constructed of any suitable materials to transfer signals. The wire bonds may be implemented by any conventional or other conductors. The microstrip transmission lines may be of any quantity, shape or size, may be disposed at any suitable locations and may be constructed of any suitable materials to transfer signals. The microstrip lines may be implemented by any conventional or other conductors, may be secured to the microwave module and chassis plate via any conventional or other fastening techniques and may be installed at any orientations relative to the feedthrough pin. The microstrip lines may be coupled to the feedthrough pin via any conventional or other techniques (e.g., direct contact, via any conductors, etc.). The stubs may be of any quantity, shape or size, may be positioned at any suitable locations and may be constructed of any suitable materials. The stubs may be implemented by any conventional or other devices or techniques to obtain a shunt capacitance.

From the foregoing description, it will be appreciated that the invention makes available a novel method and apparatus for microwave interconnection, wherein microwave signals are coupled from a microwave module to a chassis plate microstrip line via a feedthrough pin including an insulating sleeve and a conductive gasket installed between the module and plate to reduce signal leakage and enhance feedthrough performance.

Having described preferred embodiments of a new and improved method and apparatus for microwave interconnection, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A connector for coupling microwave signals from a microwave module to a signal line placed on a support structure comprising:

a signal conductor extending from said microwave module into said support structure and coupled to said signal line to carry microwave signals from said microwave module to said signal line;

an electrically conductive gasket placed about said signal conductor between said microwave module and said support structure to reduce signal leakage and form a ground path therebetween; and an insulating sleeve placed about said signal conductor within said support structure to control impedance variation of a microwave signal path with respect to varying positions of said signal conductor and sleeve within that structure, wherein a clearance is formed between a sleeve exterior surface and a support structure internal surface to facilitate said varying positions.

2. The connector of claim 1, wherein said microwave module and said support structure are arranged in a vertical fashion with said signal conductor extending in a substantially vertical direction therebetween.

3. The connector of claim 1, wherein said signal conductor includes a pin.

4. The connector of claim 1, wherein said support structure includes a chassis plate.

5. The connector of claim 1, wherein said gasket is constructed of a pliable metal.

6. The connector of claim 1, wherein said signal conductor is placed within a channel defined within said support structure and said dimensions of said signal conductor and said insulating sleeve provide said clearance relative to said channel that maintains said microwave signal path impedance substantially independent of the position of said insulating sleeve and signal conductor within said channel.

7. The connector of claim 6, wherein said clearance is approximately 0.005 inches.

8. The connector of claim 1, wherein said signal line includes a microstrip transmission line.

9. The connector of claim 1, wherein said signal conductor is coupled to said signal line via a conductive element and said signal line includes at least one capacitive element to compensate for inductance of said conductive element coupling.

10. The connector of claim 1, wherein said microwave module includes a module signal line coupled to said signal conductor to provide microwave signals.

11. The connector of claim 10, wherein said module signal line is positioned substantially perpendicular to said signal conductor.

12. The connector of claim 10, wherein said module signal line is positioned substantially parallel to said signal conductor.

13. The connector of claim 10, wherein said signal conductor is coupled to said module signal line via a conductive element and said module signal line includes at least one capacitive element to compensate for inductance of said conductive element coupling.

14. A connector for coupling microwave signals from a microwave module to a signal line placed on a support structure comprising:

a signal conductor extending from said microwave module into said support structure and coupled to said signal line to carry microwave signals from said microwave module to said signal line;

an electrically conductive gasket placed about said signal conductor between said microwave module and said support structure to reduce signal leakage and form a ground path therebetween; and an insulating sleeve placed about said signal conductor within said support structure to control impedance of a microwave signal path within that structure;

wherein said microwave module includes a module signal line coupled to said signal conductor to provide microwave signals and said module signal line includes a microstrip transmission line.

15. A connector for coupling microwave signals from a microwave module to a signal line placed on a support structure comprising:

a signal conductor extending from said microwave module into said support structure and coupled to said signal line to carry microwave signals from said microwave module to said signal line;

an electrically conductive gasket placed about said signal conductor between said microwave module and said support structure to reduce signal leakage and form a ground path therebetween; and an insulating sleeve placed about said signal conductor within said support structure to control impedance of a microwave signal path within that structure;

wherein said microwave module includes a seal placed about said signal conductor to maintain signals within said microwave module.

16. A method of coupling microwave signals from a microwave module to a signal line placed on a support structure comprising:

(a) transporting microwave signals from said microwave module to said support structure via a signal conductor extending from said microwave module into said support structure and coupled to said signal line;

(b) forming a ground path and reducing signal leakage between said microwave module and said support structure via an electrically conductive gasket placed about said signal conductor; and (c) controlling impedance variation of a microwave signal path with respect to varying positions of said signal conductor within said support structure via an insulating sleeve placed about said signal conductor within that structure with a clearance gap formed between a sleeve exterior surface and a support structure internal surface to facilitate said varying positions.

17. The method of claim 16, wherein step (a) further includes:

(a.1) transporting microwave signals from said microwave module to said support structure, wherein said microwave module and said support structure are arranged in a vertical fashion with said signal conductor extending in a substantially vertical direction therebetween.

18. The method of claim 16, wherein said signal conductor includes a pin.

19. The method of claim 16, wherein said support structure includes a chassis plate.

20. The method of claim 16, wherein said gasket is constructed of a pliable metal.

21. The method of claim 16, wherein said signal conductor is placed within a channel defined within said support structure, and step (c) further includes:

(c.1) maintaining said microwave signal path impedance substantially independent of the position of said insulating sleeve and signal conductor within said channel via said clearance gap formed between said signal conductor with said insulating sleeve and said channel.

22. The method of claim 21, wherein said clearance gap is approximately 0.005 inches.

23. The method of claim 16, wherein said signal line includes a microstrip transmission line.

24. The method of claim 16, wherein step (a) further includes:

(a.1) coupling said signal conductor to said signal line via a conductive element, wherein said signal line includes at least one capacitive element to compensate for inductance of said conductive element coupling.

25. The method of claim 16, wherein step (a) further includes:

(a.1) transferring microwave signals to said signal conductor from a module signal line within said microwave module and coupled to said signal conductor.

26. The method of claim 25, wherein step (a.1) further includes:

(a.1.1) transferring microwave signals to said signal conductor from said module signal line placed substantially perpendicular to said signal conductor.

27. The method of claim 25, wherein step (a.1) further includes:

(a.1.1) transferring microwave signals to said signal conductor from said module signal line placed substantially parallel to said signal conductor.

28. The method of claim 25, wherein step (a.1) further includes:

(a.1.1) coupling said signal conductor to said module signal line via a conductive element, wherein said signal line includes at least one capacitive element to compensate for inductance of said conductive element coupling.

29. A method of coupling microwave signals from a microwave module to a signal line placed on a support structure comprising:

(a) transporting microwave signals from said microwave module to said support structure via a signal conductor extending from said microwave module into said support structure and coupled to said signal line, wherein step (a) further includes:

(a.1) transferring microwave signals to said signal conductor from a module signal line within said microwave module and coupled to said signal conductor, wherein said module signal line includes a microstrip transmission line;

(b) forming a ground path and reducing signal leakage between said microwave module and said support structure via an electrically conductive gasket placed about said signal conductor; and (c) controlling impedance of a microwave signal path within said support structure via an insulating sleeve placed about said signal conductor within that structure.

30. A method of coupling microwave signals from a microwave module to a signal line placed on a support structure comprising:

(a) transporting microwave signals from said microwave module to said support structure via a signal conductor extending from said microwave module into said support structure and coupled to said signal line, wherein step (a) further includes:

(a.1) maintaining signals within said microwave module via a seal placed about said signal conductor;

(b) forming a ground path and reducing signal leakage between said microwave module and said support structure via an electrically conductive gasket placed about said signal conductor; and (c) controlling impedance of a microwave signal path within said support structure via an insulating sleeve placed about said signal conductor within that structure.

* * * * *